US011920591B2

(12) United States Patent
Higuchi et al.

(10) Patent No.: US 11,920,591 B2
(45) Date of Patent: Mar. 5, 2024

(54) ELECTRIC OIL PUMP

(71) Applicants: NIDEC TOSOK CORPORATION, Zama (JP); KYB CORPORATION, Tokyo (JP)

(72) Inventors: Koji Higuchi, Zama (JP); Yutaka Hashimoto, Zama (JP); Yoshiyuki Maki, Tokyo (JP); Kohei Kubo, Tokyo (JP)

(73) Assignees: NIDEC TOSOK CORPORATION, Kanagawa (JP); KYB CORPORATION, Tokyo (JP)

( * ) Notice: Subject to any disclaimer, the term of this patent is extended or adjusted under 35 U.S.C. 154(b) by 361 days.

(21) Appl. No.: 17/290,305

(22) PCT Filed: Sep. 20, 2019

(86) PCT No.: PCT/JP2019/036985
§ 371 (c)(1),
(2) Date: Apr. 30, 2021

(87) PCT Pub. No.: WO2020/095552
PCT Pub. Date: May 14, 2020

(65) Prior Publication Data

US 2022/0034315 A1 Feb. 3, 2022

(30) Foreign Application Priority Data

Nov. 9, 2018 (JP) ..... 2018-211217

(51) Int. Cl.
*F04C 2/10* (2006.01)
*F04C 11/00* (2006.01)
(Continued)

(52) U.S. Cl.
CPC ..... *F04C 2/102* (2013.01); *F04C 11/008* (2013.01); *F04C 13/002* (2013.01); *F04C 15/06* (2013.01);
(Continued)

(58) Field of Classification Search
CPC ..... F04C 2/102; F04C 11/008; F04C 13/002; F04C 15/06; F04C 2210/206; F04C 2240/40
See application file for complete search history.

(56) References Cited

U.S. PATENT DOCUMENTS 9,334,862 B2 5/2016 Miyaki
2007/0253855 A1* 11/2007 Tsubono ..... F04C 2/084 418/61.3
(Continued)

FOREIGN PATENT DOCUMENTS

CN 102996435 A 3/2013
JP 2006-112238 A 4/2006
(Continued)

OTHER PUBLICATIONS

Official Communication issued in International Patent Application No. PCT/JP2019/036985, dated Nov. 19, 2019.

*Primary Examiner* — Connor J Tremarche
(74) *Attorney, Agent, or Firm* — Keating & Bennett, LLP

(57) ABSTRACT

An electric oil pump includes a motor including a motor shaft, a pump assembly including a vane pump driven by the motor to suction and discharge oil, and an inverter to drive the motor. The motor includes a rotor, a stator on a side outward from the rotor in a radial direction, and a motor housing containing the rotor and the stator. The motor housing includes a suction port through which the vane pump suctions oil from outside, and a discharge port through which the vane pump discharges oil to outside. The motor housing includes flat surface portions in a portion of an outer
(Continued)

periphery thereof. The suction port and the discharge port are located in a first surface of side surfaces which are the flat surface portions of the motor housing and are parallel or substantially parallel to the axial direction.

13 Claims, 9 Drawing Sheets

(51) Int. Cl.
*F04C 13/00* (2006.01)
*F04C 15/06* (2006.01)

(52) U.S. Cl.
CPC .... *F04C 2210/206* (2013.01); *F04C 2240/40* (2013.01)

(56) References Cited

U.S. PATENT DOCUMENTS

| | | | | |
|---|---|---|---|---|
| 2008/0159885 | A1* | 7/2008 | Kameya | F04C 2/102 29/888.023 |
| 2010/0172768 | A1* | 7/2010 | Liao | F04C 2/102 418/191 |
| 2014/0178239 | A1 | 6/2014 | Asaoka | |
| 2015/0240813 | A1* | 8/2015 | Yoon | F04C 2/10 417/410.4 |
| 2018/0306189 | A1* | 10/2018 | De Bontridder | F04C 28/28 |

FOREIGN PATENT DOCUMENTS

| | | | |
|---|---|---|---|
| JP | 2006-138285 | A | 6/2006 |
| JP | 2008-178922 | A | 8/2008 |
| JP | 2010-180730 | A | 8/2010 |
| JP | 2013-096283 | A | 5/2013 |
| JP | 2013-217237 | A | 10/2013 |
| JP | 2013-241837 | A | 12/2013 |
| JP | 2014-122558 | A | 7/2014 |
| JP | 2015-105601 | A | 6/2015 |
| JP | 2015-172350 | A | 10/2015 |
| JP | 2018-048609 | A | 3/2018 |

* cited by examiner

ELECTRIC OIL PUMP

CROSS REFERENCE TO RELATED APPLICATIONS

This is a U.S. national stage of PCT Application No. PCT/JP2019/036985, filed on Sep. 20, 2019, with priority under 35 U.S.C. § 119(a) and 35 U.S.C. § 365(b) being claimed from Japanese Application No. 2018-211217, filed Nov. 9, 2018, the entire disclosures of which are hereby incorporated herein by reference.

FIELD OF THE INVENTION

The present invention relates to an electric oil pump.

BACKGROUND

A structure of an electric oil pump which has a pump unit, a motor unit for driving the pump unit, and an inverter unit for driving the motor unit is known. In this electric oil pump, for example, the pump unit is disposed on one side of the motor unit in an axial direction, and the inverter unit is disposed on the other side of the motor unit in the axial direction.

For example, FIGS. 1 and 2 of Japanese Patent Laid-Open No. 2015-172350 disclose a structure in which a pump unit is disposed on one side of the motor unit in an axial direction, and a suction port and a discharge port for oil are disposed in an end surface on one side of the pump unit in the axial direction.

Incidentally, it is necessary to connect a suction port and a discharge port for oil of an electric oil pump to an external device (for example, a transmission of a vehicle) which is oil supply target using a pipe through which oil flows, but there is a problem that the pipe may become too long depending on the positions of the suction port and discharge port in the electric oil pump and assembly workability of the electric oil pump may thus deteriorate.

In response to this, it is conceivable to determine the positions of the suction port and the discharge port according to a shape of the external device, but in the structure of the electric oil pump described in Japanese Patent Laid-Open No. 2015-172350, there is a problem that the degree of freedom in the positions of the suction port and the discharge port is low and versatility is lacking.

SUMMARY

Example embodiments of the present disclosure provide electric oil pumps each achieving improved versatility.

According to a first example embodiment of the present disclosure, an electric oil pump includes a motor including a motor shaft extending along a central axis extending in an axial direction, a pump assembly including a vane pump which is on one side of the motor in an axial direction and is driven by the motor via the motor shaft to suction and discharge oil, and an inverter which is on another side of the motor in the axial direction to drive the motor. The motor includes a rotor which is rotatable together with the motor shaft, a stator which is on a side outward from the rotor in a radial direction, and a motor housing which houses the rotor and the stator. The motor housing includes a suction port through which the vane pump suctions oil from outside, and a discharge port through which the vane pump discharges oil to outside. The motor housing includes flat surface portions in a portion of an outer peripheral shape thereof. The suction port and the discharge port are provided in a first surface of side surfaces which are the flat surface portions of the motor housing and are parallel or substantially parallel to the axial direction.

According to an example embodiment of the present disclosure, it is possible to provide an electric oil pump with improved versatility.

The above and other elements, features, steps, characteristics and advantages of the present disclosure will become more apparent from the following detailed description of the example embodiments with reference to the attached drawings.

DETAILED DESCRIPTION

Figure 1:
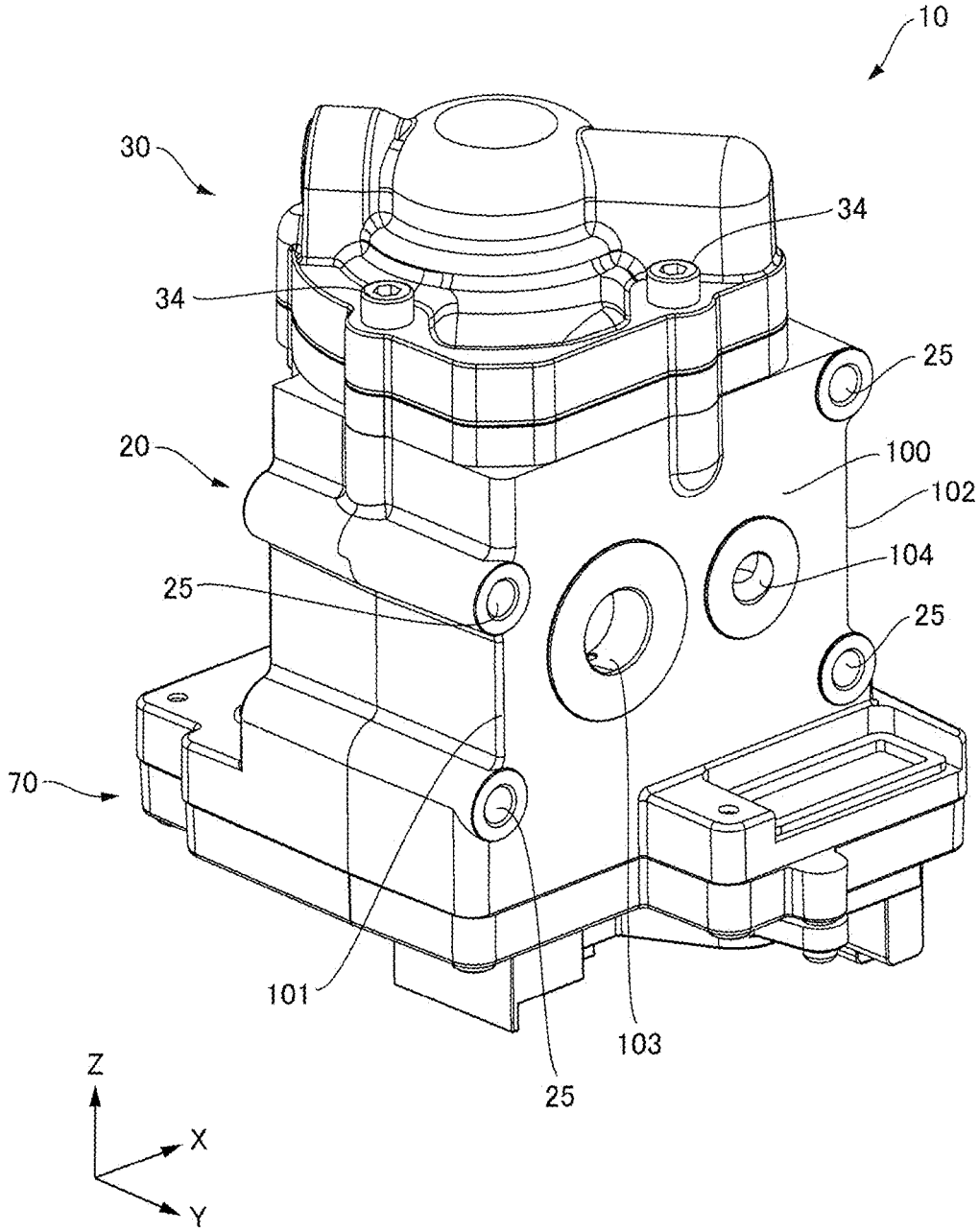
FIG. 1 is a schematic perspective view of an electric oil pump according to a first example embodiment of the present disclosure.

Hereinafter, electric oil pumps according to example embodiments of the present disclosure will be described with reference to the drawings. In the present example embodiments, an electric oil pump that supplies oil to a transmission mounted on a vehicle such as an automobile will be described, but the present disclosure is not limited to this and can be applied to an electric oil pump for any use. Further, in the following drawings, to make each constituent easier to be understood, the sizes, and numbers thereof, and the like may be different between actual structures and the respective structures.

Further, in the drawings, an XYZ coordinate system is shown as a three-dimensional orthogonal coordinate system as appropriate. In the XYZ coordinate system, a Z-axis direction is a direction parallel to an axial direction of a central axis J shown in FIG. 3 (a horizontal direction in FIG. 3). An X-axis direction is a direction parallel to a lateral direction of the electric oil pump shown in FIG. 3 (a vertical direction in FIG. 3). A Y-axis direction is a direction orthogonal to both the X-axis direction and the Z-axis direction.

Further, in the following description, a positive side in the Z-axis direction (+Z side) is referred to as "a side in front" or "one side," and a negative side in the Z-axis direction (−Z side) is referred to as "a side in rear" or "the other side." The side in rear (the other side) and the side in front (one side) are terms used only for explanation and do not limit actual positional relationships and directions. Further, unless otherwise specified, a direction parallel to the central axis J (a Z-axis direction) is simply referred to as an "axial direction," a radial direction centered on the central axis J is simply referred to as a "radial direction," and a circumferential direction centered on the central axis J, that is, a direction around an axis of the central axis J (a θ direction) is simply referred to as a "circumferential direction."

In this specification, "extending in the axial direction" includes not only a case of extending strictly in the axial direction (the Z-axis direction) but also a case of extending in a direction inclined within a range of less than 45° with respect to the axial direction. Further, in this specification, "extending in the radial direction" includes not only a case of extending strictly in the radial direction, that is, a direction perpendicular to the axial direction (the Z-axis direction) but also a case of extending in a direction inclined within a range of less than 45° with respect to the radial direction.

First Example Embodiment

<Overall Configuration>

Figure 2:
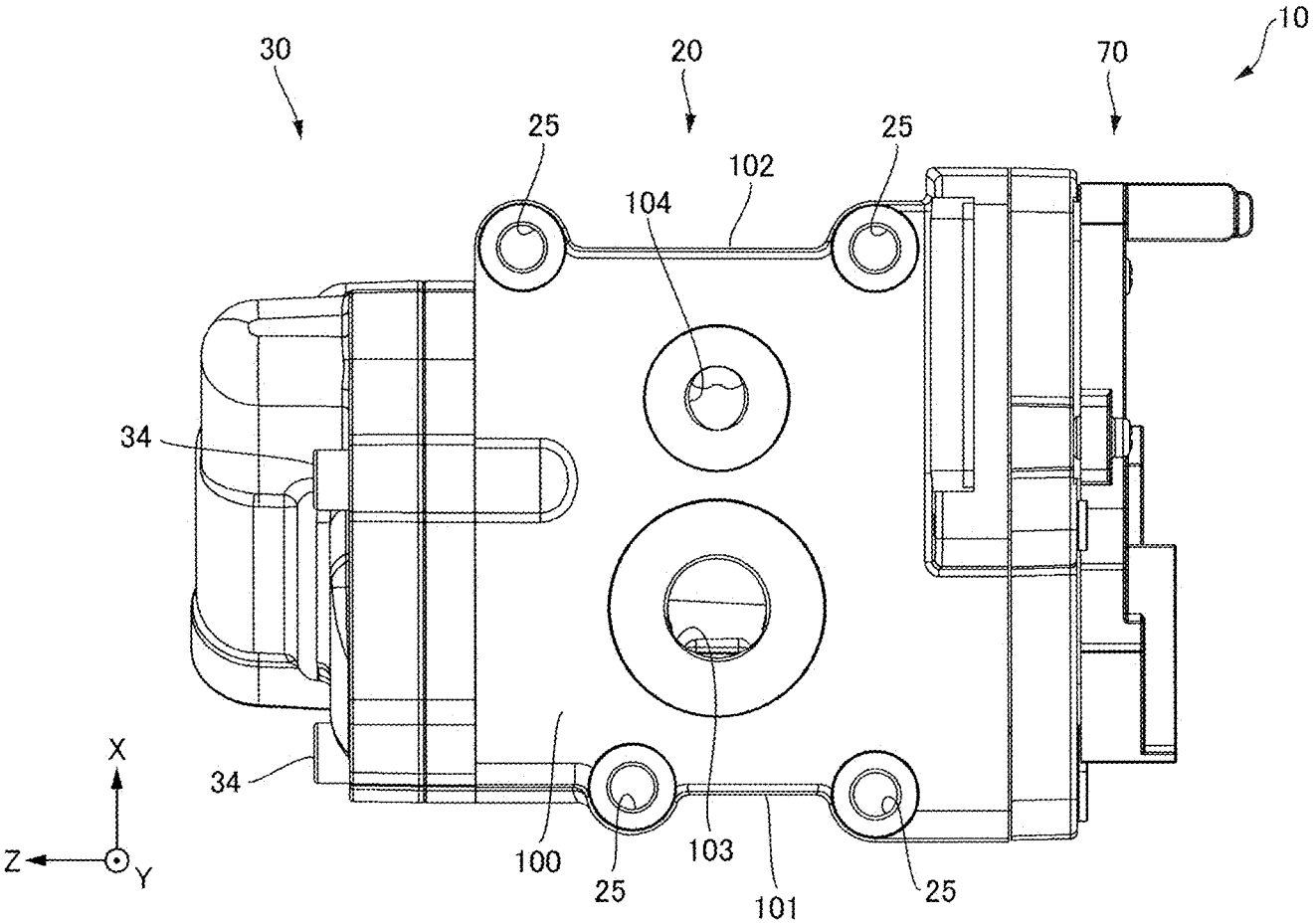
FIG. 2 is a schematic side view of the electric oil pump of FIG. 1.
Figure 3:
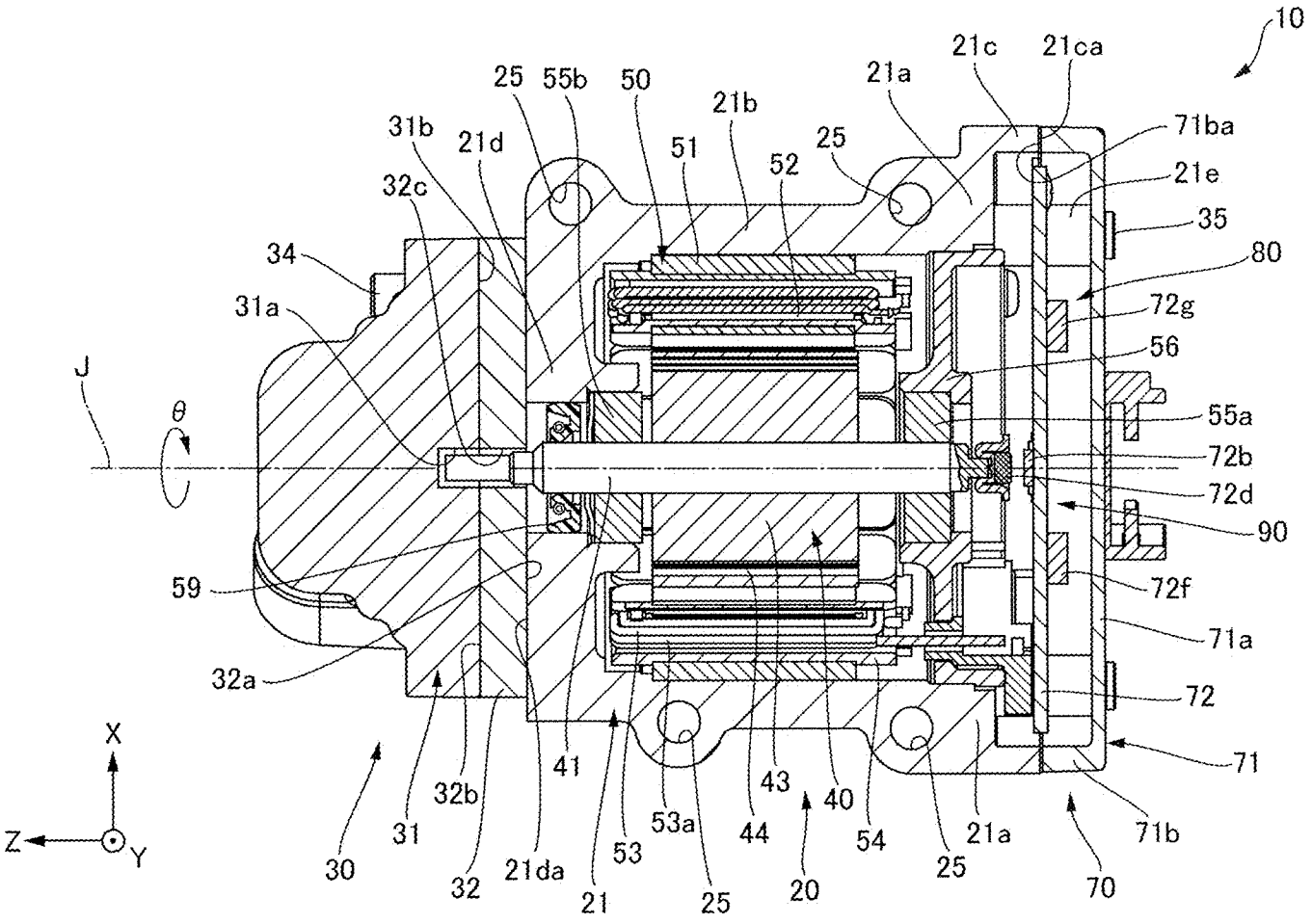
FIG. 3 is a schematic side sectional view showing the electric oil pump of FIG. 2 cut away at a position of a motor shaft 41.

FIG. 1 is a schematic perspective view of an electric oil pump according to a first example embodiment of the present disclosure. FIG. 2 is a schematic side view of the electric oil pump of FIG. 1. FIG. 3 is a schematic side sectional view showing the electric oil pump of FIG. 2 cut away at a position of a motor shaft 41.

The electric oil pump 10 of the present example embodiment has a motor 20, a pump assembly 30, and an inverter 70. The motor 20, the pump assembly 30, and the inverter 70 are provided side by side in the axial direction.

The motor 20 has a motor shaft 41 that is disposed along a central axis J extending in the axial direction and is rotatably supported around the central axis J and rotates the motor shaft 41 to drive the pump assembly 30. The pump assembly 30 is located on the side in front (+Z side) of the motor 20 and is driven by the motor 20 via the motor shaft 41 to discharge oil. The inverter 70 is located on the side in rear (−Z side) of the motor 20 and controls driving of the motor 20.

Hereinafter, each constituent member will be described in detail.

<Motor 20>

As shown in FIG. 3, the motor 20 has a motor housing 21, a rotor 40, a motor shaft 41, a stator 50, and bearings 55*a* and 55*b*.

The motor 20 is, for example, an inner rotor type motor, in which the rotor 40 is fixed to an outer peripheral surface of the motor shaft 41, and the stator 50 is located on a side outward from the rotor 40 in the radial direction. Further, the bearing 55*a* is disposed at an end portion of the motor shaft 41 on the side in rear (−Z side) to rotatably support the motor shaft 41. The bearing 55*b* is disposed at an end portion of the motor shaft 41 on the side in front (+Z side) to rotatably support the motor shaft 41. In the motor shaft 41, a seal member 59 is disposed on the side in front (+Z side) of the bearing 55*b*. The seal member 59 seals in oil leaking from the pump assembly 30.

(Motor Housing 21)

As shown in FIG. 1, the external form of the motor housing 21 has a quadrangular column shape. The motor housing 21 is not limited to having a quadrangular column shape and may be one having flat surface portions in a part of an outer peripheral shape. The motor housing 21 houses the rotor 40, the motor shaft 41, the stator 50, the bearing 55*a*, and the bearing 55*b*. The motor housing 21 has a front portion 21*d*, a rear portion 21*a*, a stator holding portion 21*b*, an end portion 21*c*, and a boss 21*e*. The front portion 21*d* is located on the side in front (+Z side). The rear portion 21*a* is located on the side in rear (−Z side). The end portion 21*c* which passes around in the circumferential direction and extends to the side in rear (−Z side) is provided on a side outward from the rear portion 21*a* in the radial direction. The boss 21*e* that extends to the side in rear (−Z side) is provided on an inner side of the rear portion 21*a* in the radial direction. The boss 21*e* has a screw hole (not shown) extending from the end surface on the side in rear (−Z side) to the side in front (+Z side). An outer surface of the stator 50, that is, an outer surface of a core back portion 51, which will be described later, is fitted to an inner surface of the stator holding portion 21*b*. Accordingly, the stator 50 is housed in the motor housing 21.

Further, the motor housing 21 has a through hole 25 that penetrates in the Y-axis direction. The electric oil pump 10 supplies oil to, for example, a vehicle transmission (not shown). When the electric oil pump 10 is assembled to the transmission, a first surface 100 of the motor housing 21 faces the transmission, and a fastening member (not shown) such as a bolt is passed through the through hole 25 to fix the electric oil pump 10 to the transmission. A suction port 103 through which the pump assembly 30 suctions oil from the outside is disposed in the first surface 100 of the motor housing 21. A discharge port 104 through which the pump assembly 30 suctions oil to the outside is disposed in the first surface 100 of the motor housing 21. The suction port 103 and the discharge port 104 are disposed in the first surface 100 that is one of side surfaces which are the flat surface portions of the motor housing 21 and are parallel to the axial direction. A diameter of the suction port 103 is larger than a diameter of the discharge port 104.

In this way, the first surface 100 faces an assembly surface (not shown) of the transmission, and the electric oil pump is fixed to the transmission. With this configuration, by assembling the electric oil pump 10 to the transmission, it is possible to connect the suction port 103 and the discharge port 104 to an oil inlet (not shown) in the assembly surface of the transmission. Therefore, an oil pipe from the suction port 103 and the discharge port 104 to the transmission can be eliminated.

Among constituent elements of the electric oil pump 10, the motor 20 is heavier than the other constituent elements. By fixing the heavy motor 20 to the transmission via the through hole 25, it is possible to improve earthquake resistance as compared with a case where the heavy constituent element is separated from a portion to be fixed.

The first surface 100 is one of the side surfaces which are surfaces of the motor housing 21 and are parallel to the axial direction. A first side 101 is a side parallel to the axial direction of sides of the side surfaces which are surfaces of the motor housing 21 and are parallel to the axial direction. A second side 102 is a side parallel to the axial direction of sides of the side surfaces which are surfaces of the motor housing 21 and are parallel to the axial direction. The first side 101 is a side of the first surface 100. The second side 102 is a side of the first surface 100. The first side 101 is closer to the suction port 103 than the second side 102 is. The second side 102 is closer to the discharge port 104 than the first side 101 is.

Figure 6:
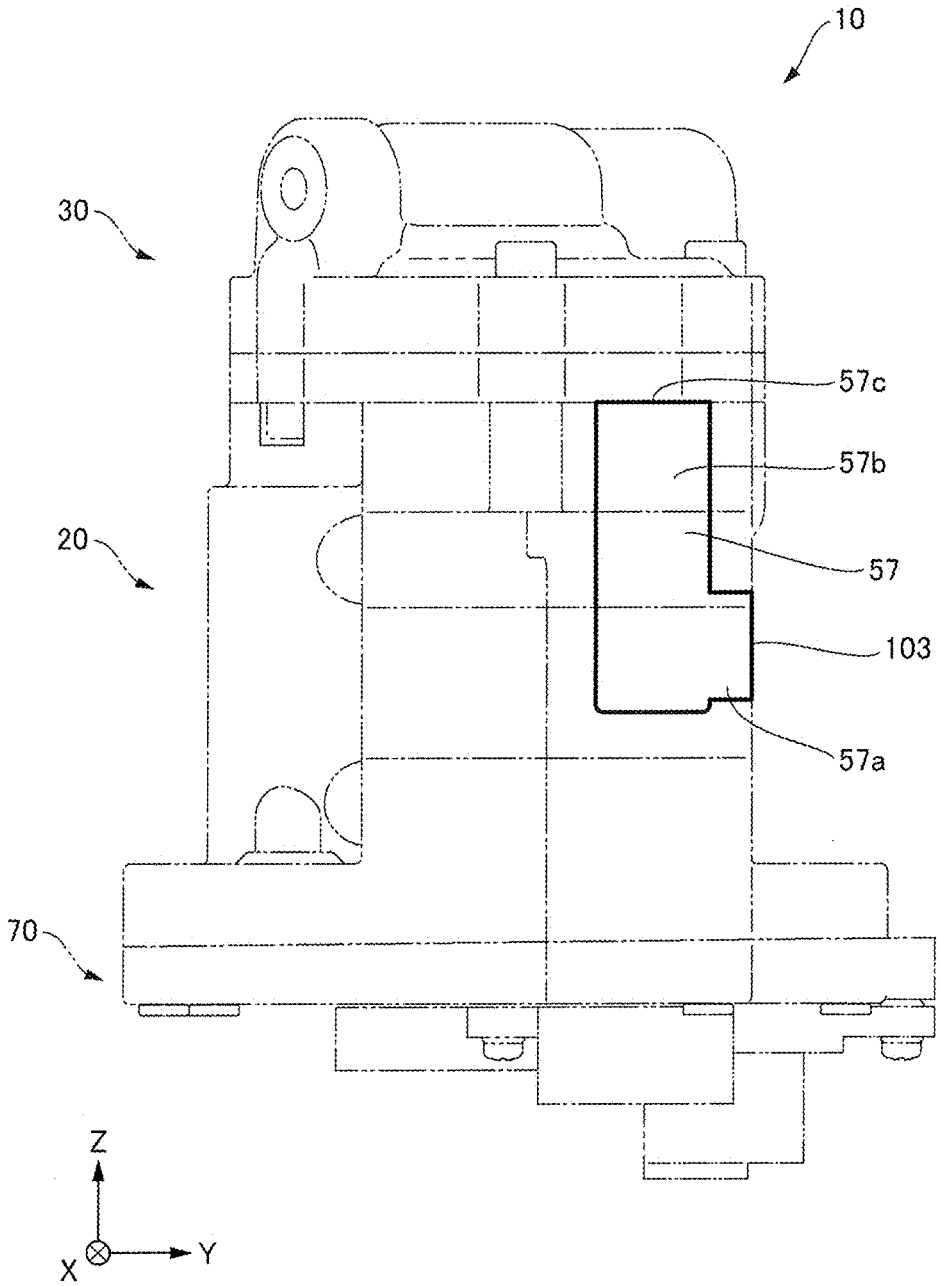
FIG. 6 is a side view of a suction oil passage 57 when seen from a −X side.
Figure 7:
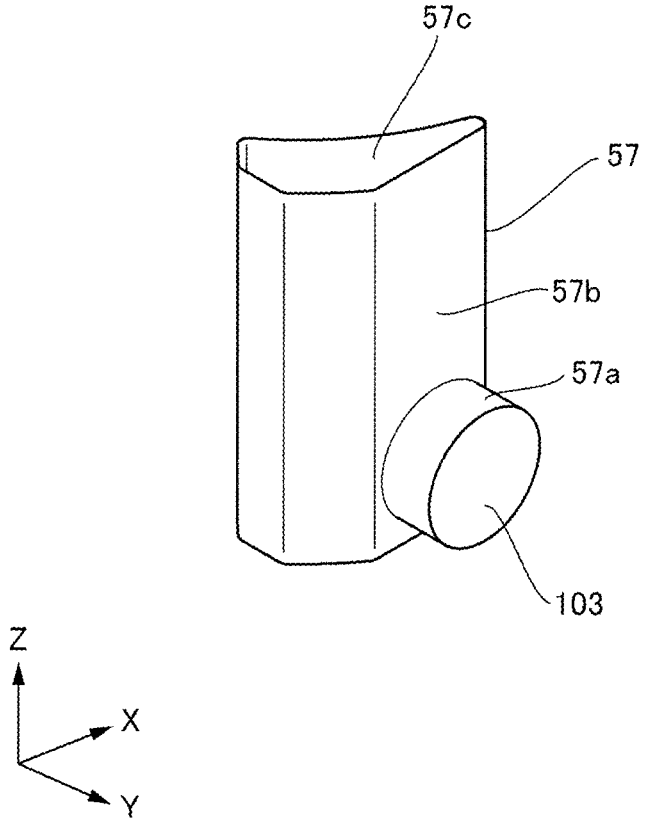
FIG. 7 is a perspective view showing a shape of the suction oil passage 57 in an extracted state.

The motor housing 21 has a suction oil passage 57, as will be described in detail with reference to FIGS. 6 and 7. The suction oil passage 57 is an oil passage that connects the suction port 103 to the pump assembly 30. The motor housing 21 has a discharge oil passage 58, as will be described in detail with reference to FIGS. 8 and 9. The discharge oil passage 58 is an oil passage that connects the pump assembly 30 to the discharge port 104.

As a material of the motor housing 21, for example, a zinc-aluminum-magnesium alloy or the like can be used, and specifically, a molten zinc-aluminum-magnesium alloy plated steel sheet or steel strip can be used. Further, the rear portion 21*a* is provided with a bearing holding portion 56 for holding the bearing 55*a*.

(Rotor 40)

The rotor 40 has a rotor core 43 and a rotor magnet 44. The rotor core 43 surrounds the motor shaft 41 in a direction around an axis thereof (the 0 direction) and is fixed to the motor shaft 41. The rotor magnet 44 is fixed to an outer surface of the rotor core 43 in a direction around an axis thereof (the 0 direction). The rotor core 43 and the rotor magnet 44 rotate together with the motor shaft 41.

(Stator 50)

The stator 50 surrounds the rotor 40 in a direction around an axis thereof (the θ direction) and rotates the rotor 40 around the central axis J. The stator 50 has a core back portion 51, a tooth portion 52, a coil 53, and a bobbin (an insulator) 54.

The shape of the core back portion 51 is a cylindrical shape concentric with the motor shaft 41. The tooth portion 52 extends from an inner surface of the core back portion 51 toward the motor shaft 41. A plurality of tooth portions 52 are provided and are disposed at equal intervals in the circumferential direction of the inner surface of the core back portion 51. The coil 53 is provided around the bobbin (the insulator) 54 and is formed by a conductive wire 53*a* being wound. The bobbin (the insulator) 54 is attached to each tooth portion 52.

(Bearings 55*a* and 55*b*)

The bearing 55*a* is disposed on the side in rear (−Z side) of the rotor 40 and the stator 50 and is held by the bearing holding portion 56. The bearing 55*a* supports the motor shaft 41 on the side in rear. The bearing 55*b* is disposed on the side in front (+Z side) of the rotor 40 and the stator 50, and is held by the front portion 21*d*. The bearing 55*b* supports the motor shaft 41 on the side in front. The shapes, the structures, and the like of the bearings 55*a* and 55*b* are not particularly limited, and any known bearing can be used.

(Rotation Angle Sensor Magnet 72*d*)

The motor 20 has a rotation angle sensor magnet 72*d*. The rotation angle sensor magnet 72*d* is disposed at the end portion of the motor shaft 41 on the side in rear (−Z side). The rotation angle sensor magnet 72*d* is fixed to the end portion of the motor shaft 41 on the side in rear (−Z side) and rotates together with the rotation of the motor shaft 41. By detecting a rotation angle of the rotation angle sensor magnet 72*d*, it is possible to detect a rotation angle of the motor shaft 41.

<Pump Assembly 30>

The pump assembly 30 is provided on one side in the axial direction of the motor 20, specifically, on the side in front (+Z side). The pump assembly 30 has the same rotation shaft as the motor 20 and is driven by the motor 20 via the motor shaft 41. The pump assembly 30 is a vane pump. The pump assembly 30 includes an intermediate member 32, a pump body 31, and a pump rotor (not shown). The pump rotor rotates together with the motor shaft 41.

(Intermediate Member 32)

The intermediate member 32 is a plate-shaped member disposed between the motor housing 21 and the pump body 31. A surface 32*a* which is a surface of the intermediate member 32 on the side in rear (−Z side) is in contact with a surface 21*da* which is a surface of the front portion 21*d* of the motor housing 21 on the side in front (+Z side). A surface 32*b* which is a surface of the intermediate member 32 on the side in front (+Z side) is in contact with a surface 31*b* which is a surface of the pump body 31 on the side in rear (−Z side). The pump body 31 and the intermediate member 32 are fixed (screw-fixed) to the motor housing 21 using fastening members 34 such as bolts. The intermediate member 32 has an oil passage (not shown) that connects the suction oil passage 57 of the motor housing 21 to the pump body 31. The intermediate member 32 has an oil passage (not shown) that connects the pump body 31 to the discharge oil passage 58 of the motor housing 21. The intermediate member 32 has a through hole 32*c* that penetrates in the axial direction. The motor shaft 41 passes through the through hole 32*c*.

(Pump Body 31)

The pump body 31 is located on the side in front (+Z side) of the intermediate member 32. The pump body 31 has a recess 31*a* that reaches the pump rotor. A tip end of the motor shaft 41 on the side in front (+Z side) is fitted into the recess 31*a*.

Figure 4:
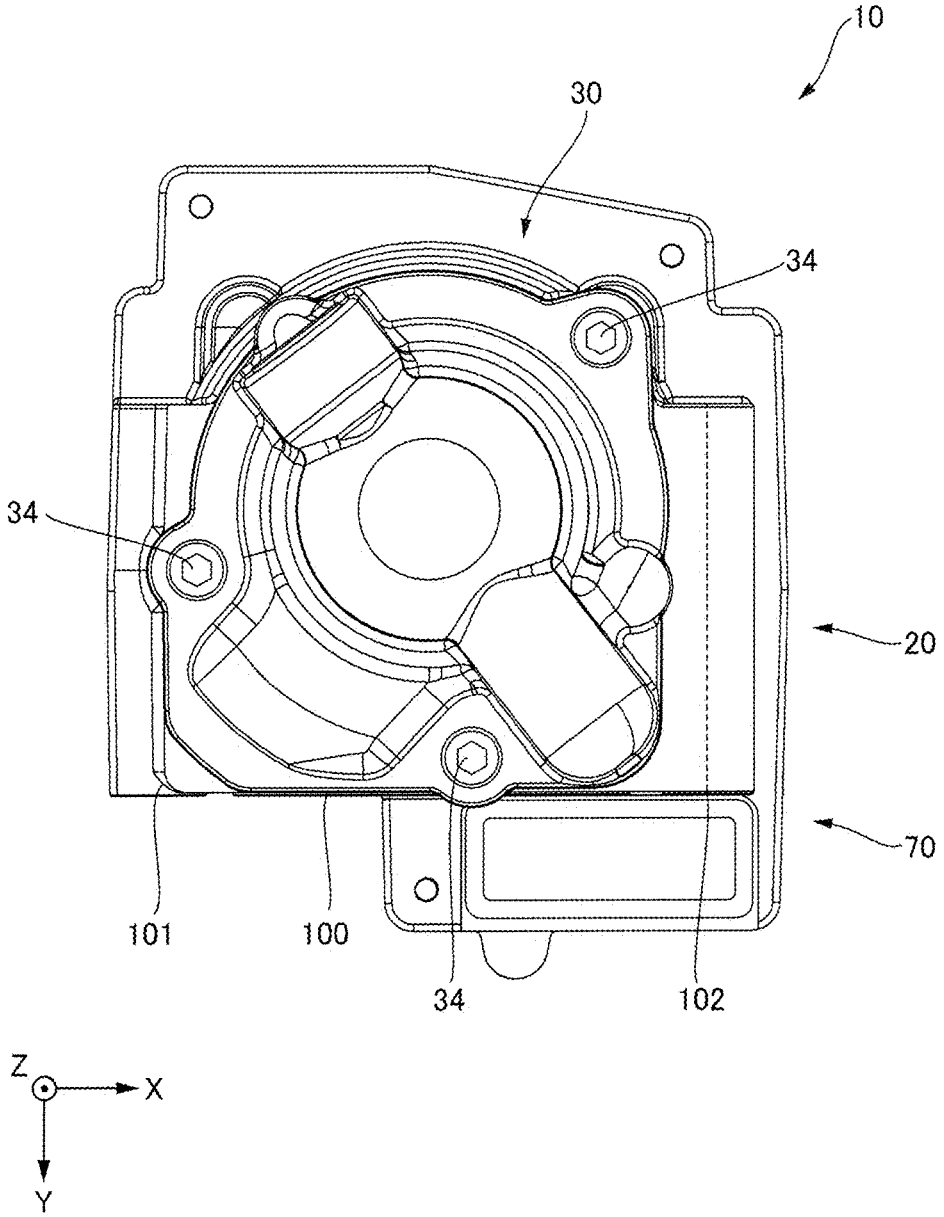
FIG. 4 is a plan view of the electric oil pump 10 of FIG. 1 when seen from a side (a +Z side).

FIG. 4 is a plan view of the electric oil pump 10 of FIG. 1 when seen from the side in front (the +Z side). The fastening members 34 for fixing the pump body 31 and the intermediate member to the motor housing 21 are disposed at intervals in the circumferential direction. In the present example embodiment, three fastening members 34 are provided. The fastening members 34 are disposed at positions that do not overlap the suction oil passage 57 and the discharge oil passage 58.

<Inverter 70>

The inverter 70 is provided on the side in rear (−Z side) of the motor 20 and controls driving of the motor 20. The inverter 70 includes an inverter housing 71 and a substrate 72.

(Inverter Housing 71)

The inverter housing 71 has a bottomed cylindrical shape and has a bottom surface portion 71*a* and a side wall portion 71*b*. The bottom surface portion 71*a* expands in a direction parallel to a plane orthogonal to the central axis J. The side wall portion 71*b* extends from an end portion on a side outward from the bottom surface portion 71*a* in the radial direction to the side in front (+Z side).

The inverter housing 71 is disposed on the side in rear (−Z side) of the motor 20. An end surface 71*ba* which is an end surface of the side wall portion 71*b* on the side in front (+Z side) is in contact with an end surface 21*ca* which is an end surface of the end portion 21*c* of the motor housing 21 on the side in rear (−Z side). The inverter housing 71 is fixed to the motor housing 21 by the inverter housing 71 and the boss 21*e* of the motor housing 21 being fastened using a fastening member 35 such as a bolt.

The substrate 72 is fixed to the motor housing 21 using a fastening member (not shown) such as a bolt. The substrate 72 may be fixed to the inverter housing 71 by a fastening member (not shown) such as a bolt.

(Substrate 72)

A rotation angle detection sensor 72*b* constituting a rotation angle detection circuit 90 is mounted on the substrate 72. Electronic components 72*f* and 72*g* constituting an inverter circuit 80 for driving the motor 20 are mounted on the substrate 72. The electronic components 72*f* and 72*g* include heat generating elements such as switching elements (for example, field effect transistors (FETs), insulated gate bipolar transistors (IGBTs)) and capacitors.

The rotation angle detection sensor 72*b* is mounted on a surface of the substrate 72 on the side in front (+Z side). The electronic components 72*f* and 72*g* are mounted on a surface of the substrate 72 on the side in rear (−Z side).

The rotation angle detection sensor 72*b* is disposed at a position facing the rotation angle sensor magnet 72*d*. When the motor shaft 41 rotates, the rotation angle sensor magnet 72*d* also rotates, which changes magnetic flux. The rotation angle detection sensor 72*b* is, for example, an MR sensor and detects a change in magnetic flux due to the rotation of the rotation angle sensor magnet 72*d*, thereby detecting the rotation angle of the motor shaft 41. The rotation angle detection sensor 72*b* that detects the rotation angle of the motor shaft 41 is not limited to one that detects the change in magnetic flux due to the rotation of the magnet as in the present example embodiment, and an encoder or the like may be used.

(Inverter Circuit 80)

The inverter circuit 80 is configured by the electronic components 72*f* and 72*g* and various electronic components (not shown) being mounted on the substrate 72. The inverter circuit 80 includes the heat generating elements. The inverter circuit 80 supplies electric power to the motor 20 and controls operations such as driving, rotating, and stopping the motor 20. This control can be performed based on the rotation angle of the motor shaft 41 which is detected by the rotation angle detection circuit 90.

(Rotation Angle Detection Circuit 90)

The rotation angle detection circuit 90 is configured by the rotation angle detection sensor 72*b* and various electronic components (not shown) being mounted on the substrate 72. The rotation angle detection circuit 90 detects the rotation angle of the motor shaft 41. The detection result of the rotation angle detection circuit 90 can be transmitted to the inverter circuit 80 via printed wiring on the substrate 72.

(Suction Oil Passage 57 and Discharge Oil Passage 58)

Figure 5:
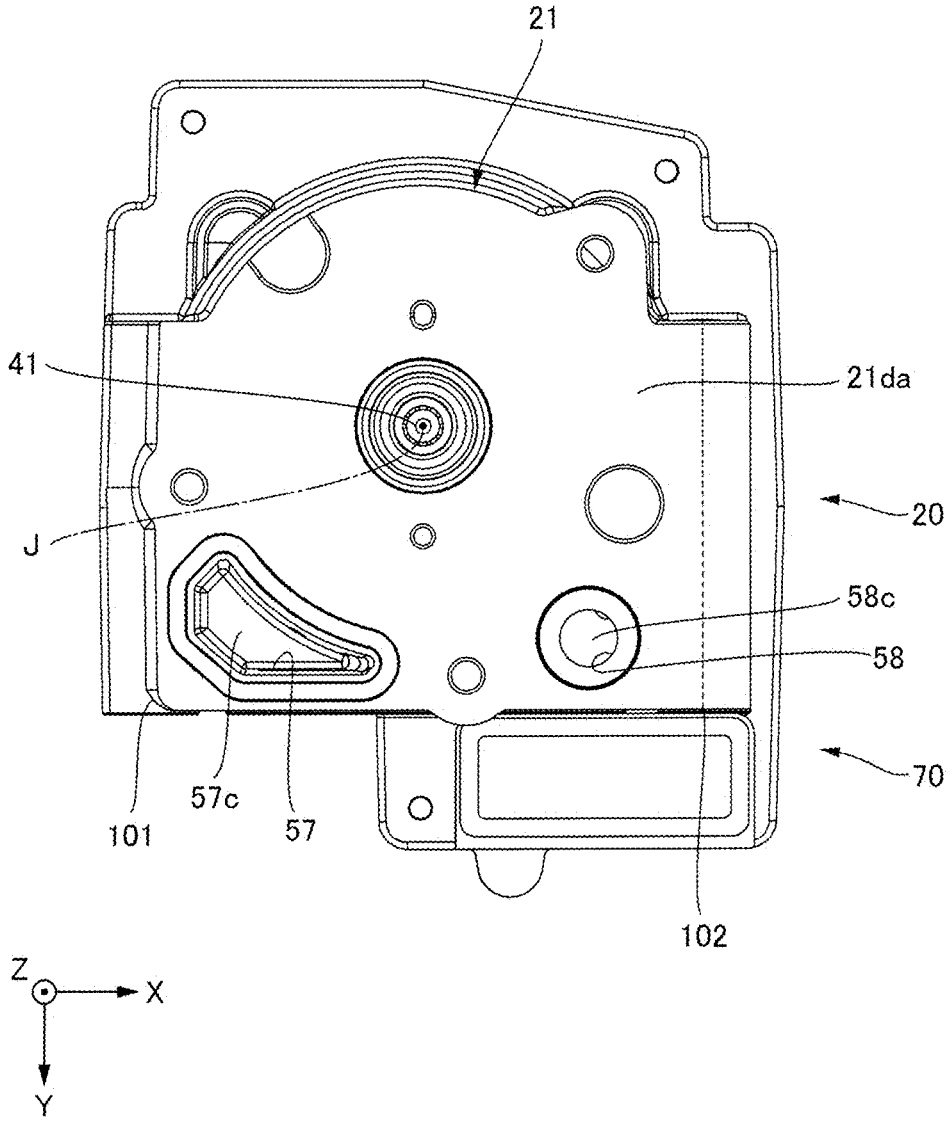
FIG. 5 is a plan view of the electric oil pump 10 of FIG. 1 when seen from a side in front (a +Z side), which shows a state in which a pump assembly 30 is removed.
Figure 8:
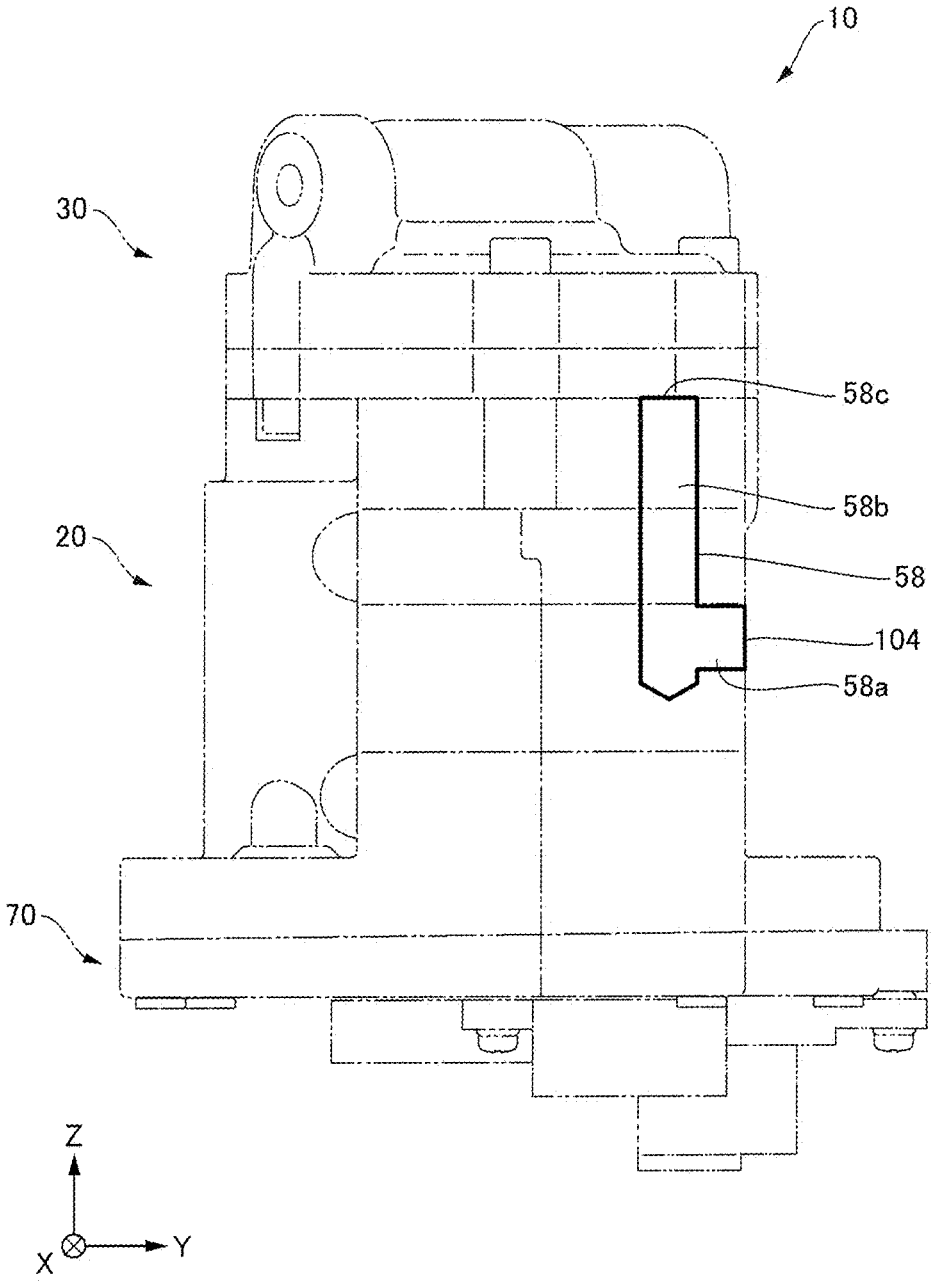
FIG. 8 is a side view of a discharge oil passage 58 when seen from a −X side.
Figure 9:
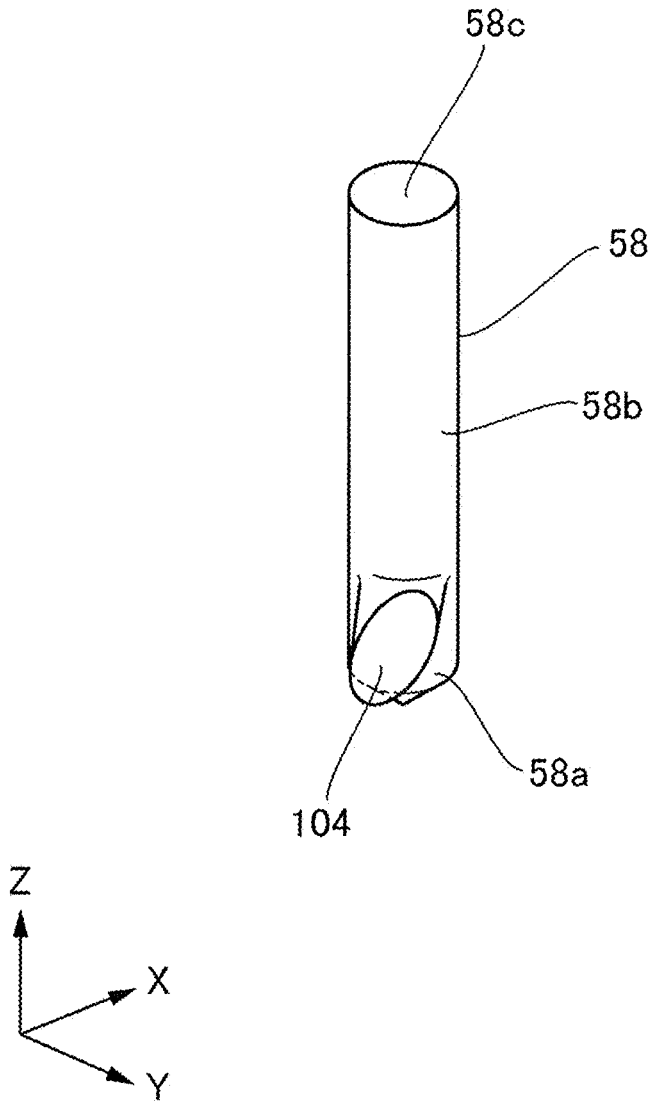
FIG. 9 is a perspective view showing a shape of the discharge oil passage 58 in an extracted state.

FIG. 5 is a plan view of the electric oil pump 10 of FIG. 1 when seen from the side in front (the +Z side), which shows a state in which the pump assembly 30 is removed. FIG. 6 is a side view of the suction oil passage 57 when seen from the −X side. FIG. 7 is a perspective view showing a shape of the suction oil passage 57 in an extracted state. FIG. 8 is a side view of the discharge oil passage 58 when seen from the −X side. FIG. 9 is a perspective view showing a shape of the discharge oil passage 58 in an extracted state.

As shown in FIG. 5, the suction oil passage 57 has an opening 57*c* in the surface 21*da* which is a surface of the motor housing 21 on the side in front (+Z side). Further, the discharge oil passage 58 has an opening 58*c* in the surface 21*da*. As shown in FIG. 5, at least a part of the suction oil passage 57 is disposed between the first side 101 and the motor shaft 41 (the central axis J). Further, at least a part of the discharge oil passage 58 is disposed between the second side 102 and the motor shaft 41 (the central axis J).

The suction oil passage 57 has an oil passage 57*a* of which one end is connected to the suction port 103 and the other end is connected to an oil passage 57*b*, and the oil passage 57*b* of which one end is connected to the oil passage 57*a* and the other end is connected to the opening 57*c*. The discharge oil passage 58 has an oil passage 58*a* of which one end is connected to the discharge port 104 and the other end is connected to an oil passage 58*b*, and the oil passage 58*b* of which one end is connected to the oil passage 58*a* and the other end is connected to the opening 58*c*. The volume of the suction oil passage 57 is larger than the volume of the discharge oil passage 58.

The oil passage 57*a* is an oil passage extending in the radial direction. The oil passage 58*a* is an oil passage extending in the radial direction. The oil passage 57*a* is an oil passage orthogonal to the axial direction. The oil passage 58*a* is an oil passage orthogonal to the axial direction. The oil passage 57*b* is an oil passage extending in the axial direction. The oil passage 58*b* is an oil passage extending in the axial direction. The oil passage 57*b* is an oil passage parallel to the axial direction. The oil passage 58*b* is an oil passage parallel to the axial direction. By providing the suction oil passage 57 and the discharge oil passage 58 in the motor housing 21, it is possible to dissipate the heat of the stator 50 to the oil flowing through the suction oil passage 57 and the discharge oil passage 58.

<Operation and Effect of Electric Oil Pump>

Next, the operation and effect of the electric oil pump will be described.

(1) The disclosure according to the above-described example embodiment includes a motor having a motor shaft which is disposed along a central axis extending in an axial direction, a pump assembly having a vane pump which is disposed on one side of the motor in the axial direction and is driven by the motor via the motor shaft to suction and discharge oil, and an inverter which is disposed on the other side of the motor in the axial direction to drive the motor, wherein the motor includes a rotor which is rotatable together with the motor shaft, a stator which is disposed on a side outward from the rotor in a radial direction, and a motor housing which houses the rotor and the stator, wherein the motor housing includes a suction port through which the vane pump suctions oil from outside, and a discharge port through which the vane pump discharges oil to outside, wherein the motor housing has flat surface portions in a part of an outer peripheral shape thereof, and wherein the suction port and the discharge port are disposed in a first surface of side surfaces which are the flat surface portions of the motor housing and are parallel to the axial direction.

By disposing the suction port and the discharge port in the first surface of the motor housing, and thus by connecting the first surface to an external device (for example, a transmission), it is possible to connect both the suction port and the discharge port to the external device, and thus it is possible to improve assembling workability. In addition, a pipe for connecting the suction port and the discharge port to the external device can be eliminated.

According to the present disclosure, by disposing the suction port and the discharge port in the motor housing, it is possible to increase the degree of freedom in the disposition positions, and thus it is possible to improve versatility.

(2) Further, an outer shape of the motor housing is a quadrangular column shape.

Since the outer shape of the motor housing is a quadrangular column shape, a manufacturing process of the motor housing can be simplified.

(3) Further, the motor housing includes a suction oil passage from the suction port to the vane pump, and a discharge oil passage from the vane pump to the discharge port, the suction oil passage includes an axial suction oil passage extending in the axial direction, and the discharge oil passage includes an axial discharge oil passage extending in the axial direction.

It is possible to connect the suction port and the discharge port in the first surface of the motor housing and the vane pump disposed on one side of the motor in the axial direction using the oil passage extending in the axial direction.

Further, it is possible to dissipate the heat of the motor to the oil flowing through the oil passage extending in the axial direction.

(4) Further, the motor housing includes a suction oil passage from the suction port to the vane pump, and a discharge oil passage from the vane pump to the discharge port, the suction oil passage includes a parallel suction oil passage parallel to the axial direction, and the discharge oil passage includes a parallel discharge oil passage parallel to the axial direction.

It is possible to connect the suction port and the discharge port in the first surface of the motor housing and the vane pump disposed on one side of the motor in the axial direction using the oil passage parallel to the axial direction.

Further, it is possible to dissipate the heat of the motor to the oil flowing through the oil passage parallel to the axial direction.

(5) Further, the motor housing includes a suction oil passage from the suction port to the vane pump, and a discharge oil passage from the vane pump to the discharge port, the suction oil passage includes a radial suction oil passage extending in the radial direction, and the discharge oil passage includes a radial discharge oil passage extending in the radial direction.

By providing the radial suction oil passage and the radial discharge oil passage, it is possible to form the oil passage even in a case in which the diameter of the vane pump and the diameter of the motor housing are different, and thus it is possible to increase the degree of freedom in design.

(6) Further, the motor housing includes a suction oil passage from the suction port to the vane pump, and a discharge oil passage from the vane pump to the discharge port, the suction oil passage includes an orthogonal suction oil passage orthogonal to the axial direction, and the discharge oil passage includes an orthogonal discharge oil passage orthogonal to the axial direction.

By providing the orthogonal suction oil passage and the orthogonal discharge oil passage, it is possible to form the oil passage even in a case in which the diameter of the vane pump and the diameter of the motor housing are different, and thus it is possible to increase the degree of freedom in design.

(7) Further, at least a part of the suction oil passage is disposed between a first side which is a side of sides of the side surfaces which is parallel to the axial direction and the central axis, at least a part of the discharge oil passage is disposed between a second side which is a side of sides of the side surfaces which is parallel to the axial direction and the central axis, and the first side is a side different from the second side.

The regions of the motor housing between the first side and the central axis and between the second side and the central axis can be effectively used as oil passages.

(8) Further, the first side and the second side are sides of the first surface.

By using the regions of the motor housing between the first side which is a side of the first surface and the central axis and between the second side which is a side of the first surface and the central axis as oil passages, it is possible to shorten the oil passage between the suction port and the discharge port and the vane pump.

(9) Further, a diameter of the suction port is larger than a diameter of the discharge port.

Since the diameter of the suction port is larger than the diameter of the discharge port, it is possible to reduce the resistance on the suction side, the pump assembly operates smoothly, and thus it is possible to prevent cavitation from occurring.

(10) Further, a volume of the suction oil passage is larger than a volume of the discharge oil passage.

Since the volume of the suction oil passage is larger than the volume of the discharge oil passage, it is possible to reduce the resistance on the suction side, the pump assembly operates smoothly, and thus it is possible to prevent cavitation from occurring.

(11) Further, the pump assembly is screw-fixed to the motor housing using a bolt, and the bolt is disposed at a position not overlapping the suction oil passage and the discharge oil passage in the axial direction.

Since the position of the bolt is a position not overlapping the suction oil passage and the discharge oil passage in the axial direction, it is possible to secure a sufficient length of the bolt, and thus it is possible to firmly fix the pump assembly to the motor housing.

(12) Further, three bolts are disposed at intervals in a circumferential direction.

By disposing the three bolts at intervals in the circumferential direction, it is possible to firmly fix the pump assembly to the motor housing.

The use of the electric oil pump of the above-described example embodiment is not particularly limited. The electric oil pump of the above-described example embodiment is mounted on, for example, a vehicle. In addition, the above-mentioned configurations can be appropriately combined within a range that they do not contradict each other.

In the above, the preferred example embodiments of the present disclosure have been described, however the present disclosure is not limited to these example embodiments, and various modifications and changes can be made within the scope of the gist thereof. These example embodiments and modifications thereof are included in the scope and gist of the disclosure and are included in the scope of the disclosure described in the claims and the equivalent scope thereof.

Priority is claimed on Japanese Patent Application No. 2018-211217, filed Nov. 9, 2018, the content of which is incorporated herein by reference.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. An electric oil pump comprising:

a motor including a motor shaft extending along a central axis extending in an axial direction;

a pump assembly including a vane pump which is on one side of the motor in the axial direction and is driven by the motor via the motor shaft to suction and discharge oil; and an inverter which is on another side of the motor in the axial direction to drive the motor; wherein the motor includes:

a rotor which is rotatable together with the motor shaft;

a stator which is on a side outward from the rotor in a radial direction that intersects the axial direction; and a motor housing which houses the rotor and the stator;

the pump assembly includes a pump body that is connected to one side of the motor housing in the axial direction;

the vane pump is housed within the pump body;

the motor housing includes:

a suction port through which the vane pump suctions oil from outside;

a discharge port through which the vane pump discharges oil to outside;

a suction oil passage leads from the suction port to the vane pump; and a discharge oil passage leads from the vane pump to the discharge port;

the suction oil passage and the discharge oil passage include:

an axial oil passage extending from the pump assembly towards the motor in the axial direction; and a radial oil passage extending in the radial direction and leading to the suction port or the discharge port;

the axial oil passage overlaps the stator when viewed along the radial direction;

the motor housing includes a flat surface portion in a portion of an outer peripheral shape thereof;

the flat surface includes a first surface which extends in parallel to the axial direction; and the suction port and the discharge port are located on the first surface.

2. The electric oil pump according to claim 1, wherein an outer shape of the motor housing is a quadrangular column shape.

3. The electric oil pump according to claim 2, wherein the suction oil passage includes a parallel suction oil passage parallel or substantially parallel to the axial direction; and the discharge oil passage includes a parallel discharge oil passage parallel or substantially parallel to the axial direction.

4. The electric oil pump according to claim 1, wherein the suction oil passage includes a radial suction oil passage extending in the radial direction; and the discharge oil passage includes a radial discharge oil passage extending in the radial direction.

5. The electric oil pump according to claim 2, wherein the suction oil passage includes a radial suction oil passage extending in the radial direction; and the discharge oil passage includes a radial discharge oil passage extending in the radial direction.

6. The electric oil pump according to claim 1, wherein the suction oil passage includes an orthogonal suction oil passage orthogonal or substantially orthogonal to the axial direction; and the discharge oil passage includes an orthogonal discharge oil passage orthogonal or substantially orthogonal to the axial direction.

7. The electric oil pump according to claim 2, wherein the suction oil passage includes an orthogonal suction oil passage orthogonal or substantially orthogonal to the axial direction; and the discharge oil passage includes an orthogonal discharge oil passage orthogonal or substantially orthogonal to the axial direction.

8. The electric oil pump according to claim 1, wherein at least a portion of the suction oil passage is between a first side which is a side of the side surfaces which is parallel or substantially parallel to the axial direction and the central axis;

at least a portion of the discharge oil passage is between a second side which is a side of the side surfaces which is parallel or substantially parallel to the axial direction and the central axis; and the first side is a side different from the second side.

9. The electric oil pump according to claim 8, wherein the first side and the second side are sides of the first surface.

10. The electric oil pump according to claim 1, wherein a diameter of the suction port is larger than a diameter of the discharge port.

11. The electric oil pump according to claim 1, wherein a volume of the suction oil passage is larger than a volume of the discharge oil passage.

12. The electric oil pump according to claim 1, wherein the pump assembly is fixed to the motor housing through a bolt; and the bolt is at a position not overlapping the suction oil passage and the discharge oil passage in the axial direction.

13. The electric oil pump according to claim 12, wherein three bolts are provided at intervals in a circumferential direction.

* * * * *